US007147144B2

(12) United States Patent
Duchek

(10) Patent No.: US 7,147,144 B2
(45) **Date of Patent: *Dec. 12, 2006**

(54) EXPANDABLE CONTAINER WITH PULL CORD

(75) Inventor: Donna J. Duchek, Medina, OH (US)

(73) Assignee: Donna Duchek, Medina, OH (US)

( * ) Notice: Subject to any disclaimer, the term of this patent is extended or adjusted under 35 U.S.C. 154(b) by 423 days.

This patent is subject to a terminal disclaimer.

(21) Appl. No.: 10/662,219

(22) Filed: Sep. 12, 2003

(65) Prior Publication Data

US 2004/0060973 A1 Apr. 1, 2004

Related U.S. Application Data

(63) Continuation-in-part of application No. 10/105,987, filed on Mar. 25, 2002, now abandoned, which is a continuation-in-part of application No. 09/822,098, filed on Mar. 30, 2001, now abandoned.

(51) Int. Cl.
*B65D 43/22* (2006.01)

(52) U.S. Cl. ..... 229/125.38; 229/183

(58) Field of Classification Search ..... 229/406, 229/407, 183, 125.38, 125.28, 122.28
See application file for complete search history.

(56) References Cited

U.S. PATENT DOCUMENTS

| | | | | | |
|---|---|---|---|---|---|
| 21,749 | A | | 10/1858 | Dreyspring | |
| 307,431 | A | * | 11/1884 | Brown | 229/117.25 |
| 331,568 | A | * | 12/1885 | Tahl | 229/116.1 |
| 366,773 | A | | 7/1887 | Hamilton | |
| 587,804 | A | * | 8/1897 | Filmer | 229/125.38 |
| 616,473 | A | | 12/1898 | Knobeloch | |
| 616,869 | A | * | 12/1898 | Haas | 229/183 |
| 655,019 | A | * | 7/1900 | Schmidt | 229/104 |
| 676,393 | A | * | 6/1901 | Drawbaugh | 229/117.04 |
| 683,532 | A | * | 10/1901 | Wagnitz | 229/183 |
| 691,972 | A | | 1/1902 | Rice | |
| 692,301 | A | * | 2/1902 | Kane | 229/117.01 |
| 696,928 | A | | 4/1902 | Beecher | |
| 829,506 | A | | 8/1906 | Coleman | |
| 1,144,803 | A | * | 6/1915 | Willets | 229/125.38 |
| 1,204,367 | A | | 11/1916 | Lord | |
| 1,322,290 | A | * | 11/1919 | Cibulka | 229/125.22 |
| 1,652,844 | A | | 12/1927 | Van Wormer | |
| 1,700,733 | A | | 2/1929 | Berkowitz | |
| 1,860,349 | A | | 5/1932 | Larkin | |
| 3,004,696 | A | | 10/1961 | McCormick | |
| 4,164,316 | A | | 8/1979 | Gooding | |
| 5,437,384 | A | | 8/1995 | Farrell | |
| 5,862,980 | A | | 1/1999 | Samuelson | |

OTHER PUBLICATIONS

US pending continuation patent application entitled Expandable Container With Pull Cord, Ducheck, Jan. 2, 2004.
U.S. Appl. No. 09/822,098, filed Mar. 30, 2001, Donna J. Duchek, abandoned.
Pending U.S. Appl. No. 10/105,987, filed Mar. 25, 2002, Donna J. Duchek.

* cited by examiner

*Primary Examiner*—Tri M. Mai

(57) ABSTRACT

An expandable container generally includes at least two walls pivotably coupled along at least two junctures so as to lie substantially flat in a collapsed position. The container also includes a flap pivotably coupled to at least one of the walls. A pull cord is coupled to the flap such that pulling the cord pivotably moves the flap relative to the walls thereby expanding the walls apart from one another from the collapsed position to an expanded position. A lid is pivotably coupled to at least one of the walls for pivotable movement between at least an open position in which the lid exposes an opening defined by the expanded container and a closed position in which the lid closes the opening. The cord is adapted to be disposed over the lid and be removably engageable to the container to retain the lid in the closed position.

16 Claims, 16 Drawing Sheets

EXPANDABLE CONTAINER WITH PULL CORD

This application is a continuation-in-part of application Ser. No. 10/105,987, filed Mar. 25, 2002, now abandoned, which is a continuation-in-part of application Ser. No. 09/822,098, filed Mar. 30, 2001, now abandoned. The entire contents of each of the aforementioned patent applications are incorporated herein by reference.

FIELD

The present invention relates generally to expandable containers movable from a collapsed position to an expanded position, and more particularly (but not exclusively) to expandable containers which include a pull cord that expands the container walls to their expanded position.

BACKGROUND

Conventionally, expandable containers, such as cardboard boxes, can be formed in two positions, expanded or collapsed. The collapsed position typically corresponds to a fully flattened container, such as a box including its bottom, top and sides generally parallel with one another. This collapsed position simplifies container storage when not in use and reduces manufacturing complexity since such container may often be constructed from a single piece of material, such as cardboard.

One drawback associated with such containers is the complexity with which the containers are assembled. Often, container bottoms are formed from multiple portions that fold inward for sealing with tape or glue, forming a container bottom. Assembling such containers requires careful attention to the detailed container construction, requiring deliberate and precise folding of portions to expand the container from a flattened position. Such an assembly often also requires an additional sealing mechanism, such as glue. These containers are not useful for certain applications and users, due to their assembly complexity. This is especially true if such a container is to be used as a novelty item, gift or promotional offering, where the party providing the container wishes that the user use it with little difficulty or complex thought.

There is a need, therefore, for a product that incorporates container expandability but with an ease of use that would not deter the recipient from operating such a device.

SUMMARY

In one embodiment, an expandable container generally includes at least two walls pivotably coupled along at least two junctures so as to lie substantially flat in a collapsed position. The container also includes a flap pivotably coupled to at least one of the walls. A pull cord is coupled to the flap such that pulling the cord pivotably moves the flap relative to the walls thereby expanding the walls apart from one another from the collapsed position to an expanded position. A lid is pivotably coupled to at least one of the walls for pivotable movement between at least an open position in which the lid exposes an opening defined by the expanded container and a closed position in which the lid closes the opening. The cord is adapted to be disposed over the lid and be removably engageable to the container to retain the lid in the closed position.

In another form, the present invention provides a method of expanding and closing an expandable container. In one embodiment, the method generally includes pulling a pull cord coupled to a flap to pivotably move the flap relative to the container walls to expand the walls apart from one another from a collapsed position to an expanded position, moving a lid pivotably coupled to at least one of the walls from an open position in which the lid exposes an opening defined by the expanded container to a closed position in which the lid closes the opening, positioning the cord over the lid, and removably engaging the cord with the container to retain the lid in the closed position.

Further areas of applicability of the present invention will become apparent from the detailed description provided hereinafter. It should be understood that the detailed description and specific examples below, while indicating exemplary embodiments of the invention, are intended for purposes of illustration only and are not intended to limit the scope of the invention.

BRIEF DESCRIPTION OF THE DRAWINGS

The present invention will be more fully understood from the detailed description and the accompanying drawings, wherein.

DETAILED DESCRIPTION OF EXEMPLARY EMBODIMENTS

Figure 1:
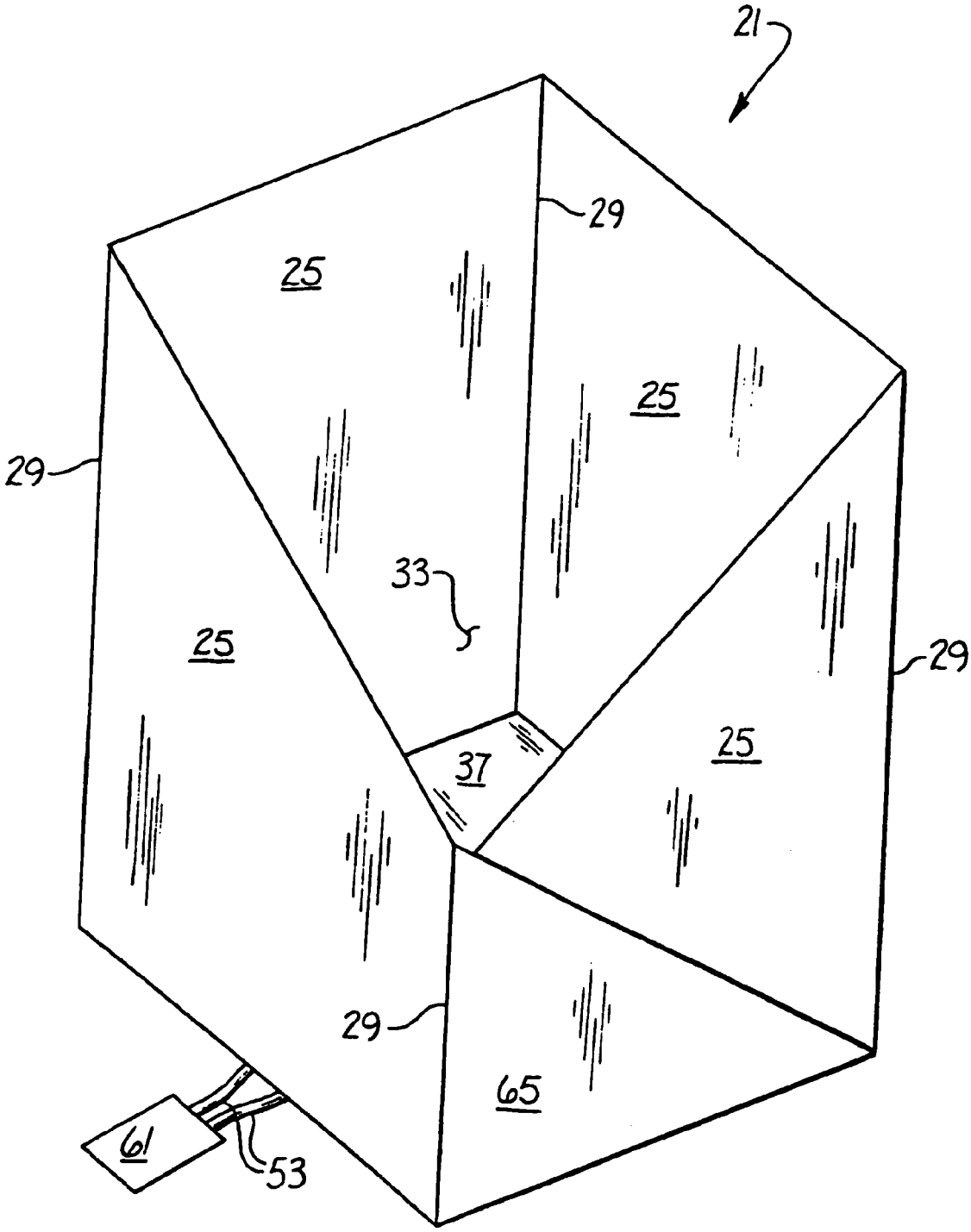
FIG. 1 is a perspective view of an expandable container according to one embodiment of the present invention.
Figure 2:
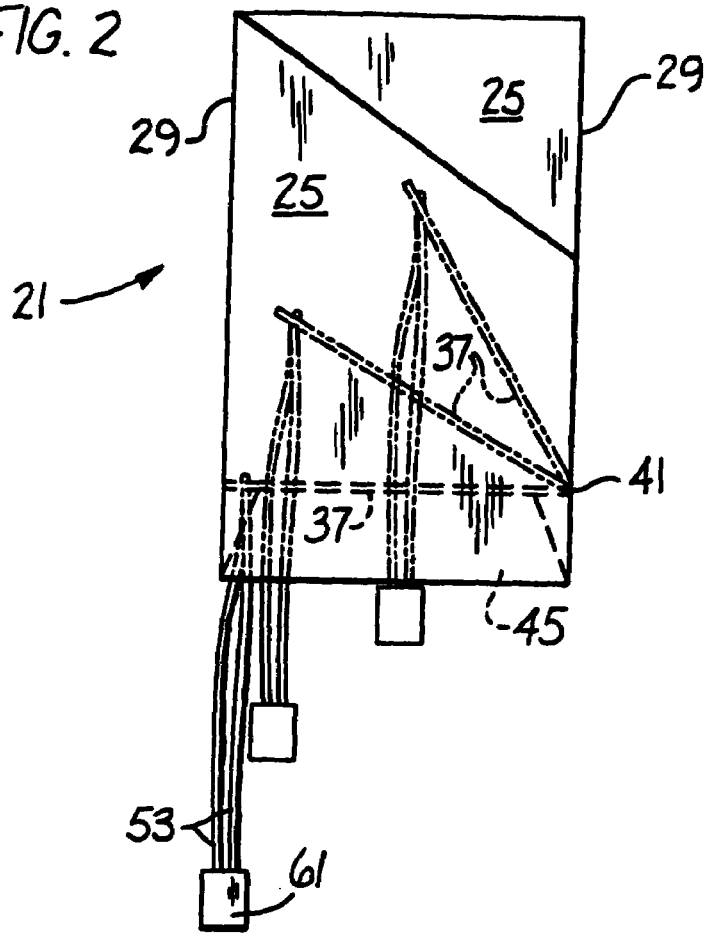
FIG. 2 is a front elevation view of the expandable container of FIG. 1 in an expanded position.
Figure 3:
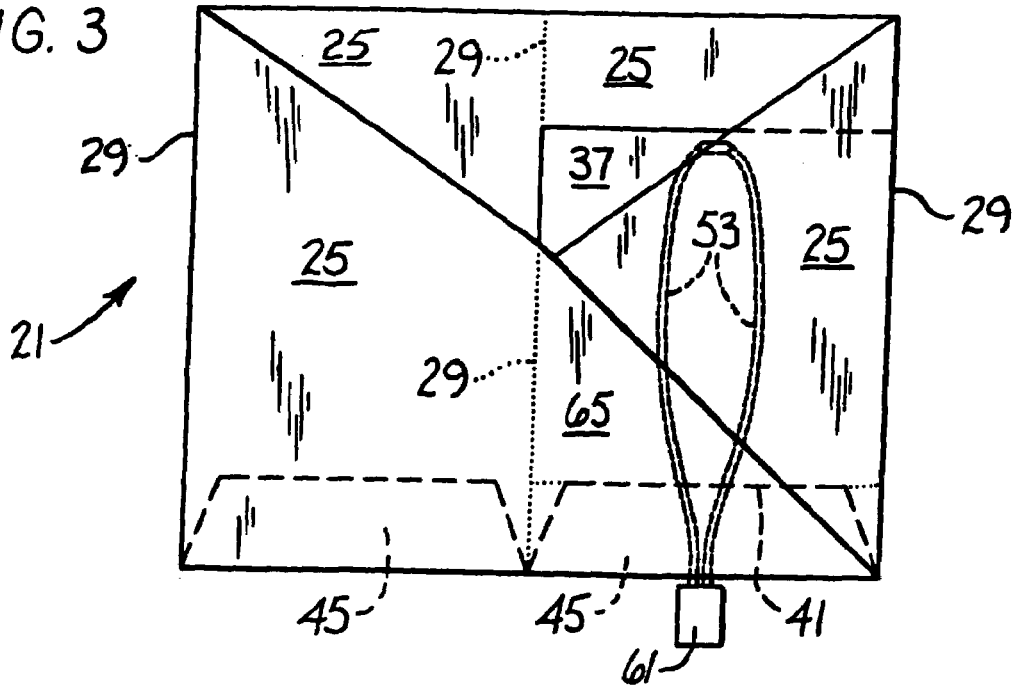
FIG. 3 is a plan view of the expandable container of FIG. 1 in a collapsed position.

Referring now to the drawings, and particularly to FIG. 1, an expandable container of the present invention is generally designated by the reference numeral 21. The container 21 comprises at least two walls 25, preferably four, pivotably inter-connectable along at least two junctures 29, preferably four. These walls 25 may be formed from cardboard, paper or other stiff material. Preferably, the walls 25 may be covered with photographs, text or graphics (not shown), making the container 21 more visually appealing. The container 21 may be formed in any size, but the preferred embodiment is directed to a container for holding small articles such as pencils, paper clips, a scarf, etc. FIGS. 1 and 2 show the container 21 in an expanded position, where the walls 25 cooperate to form an upwardly opening container including a cavity 33 for holding articles (not shown). When in a collapsed position, as shown in FIG. 3, these walls 25 lie substantially flat and parallel with respect to one another. In the collapsed position, the cavity 33 is no longer apparent and the container 21 cannot hold articles.

To facilitate altering the container 21 from the collapsed position (FIG. 3) to the expanded position (FIGS. 1 and 2), a flap 37 is attachable to at least one wall 25 along a hinged seam 41 and can pivotably move with respect to the wall about the seam (FIG. 2). Movement of the flap 37 downward, as shown in phantom lines in FIG. 2, expands the walls 25 apart from one another, converting the container 21 from its collapsed position to its expanded position. As with the walls 25 alone, the walls and flap 37 also fold together to a substantially flat, collapsed position, so that the container 21 may be more easily stored or shipped. Although designating each part of the container 21 as either wall 25 or flap 37 is preferred, the walls and flap may also be referred to more generally as panels of the container. The term panel may be used throughout as a generic term for any structural portion of the container 21, or any container named herein, including those portions that define walls, flaps, lids or portions of the container.

At least one wall 25, and preferably all four walls, additionally includes an upwardly folding stop 45 extending from the bottom edge of the wall along a fold line 49. These stops 45 are preferably folded upward for substantially flatwise engagement with their respective wall 25 of attachment. When the flap 37 rotates downward to its expanded position, the stops 45 arrest flap movement at the proper orientation.

To simplify the process of moving the flap 37 and erecting the container 21, a pull cord 53 is attachable to the flap 37, preferably via two holes 57. Other means for attaching the pull cord 53, such as adhesives or slots in the flap 37, are also contemplated as within the scope of the present invention. Pulling the pull cord 53 downward pivotably moves the flap 37 with respect to the walls 25 to expand the container 21. The pull cord 53 allows a user unfamiliar with the container 21 to erect the container from its collapsed to expanded position quickly and easily. Moreover, the pull cord 53 makes the container 21 readily usable by children, the infirm or users with little time or inclination to study a more complex container. A pull tab 61 attachable to a free end of the pull cord 53 and labeled with text or graphics (not shown) helps guide the user regarding how to use the container 21. For instance, the pull tab 61 may bear the words "Pull Here," suggesting to the user that pulling on the tab will expand the container 21.

Figure 4:
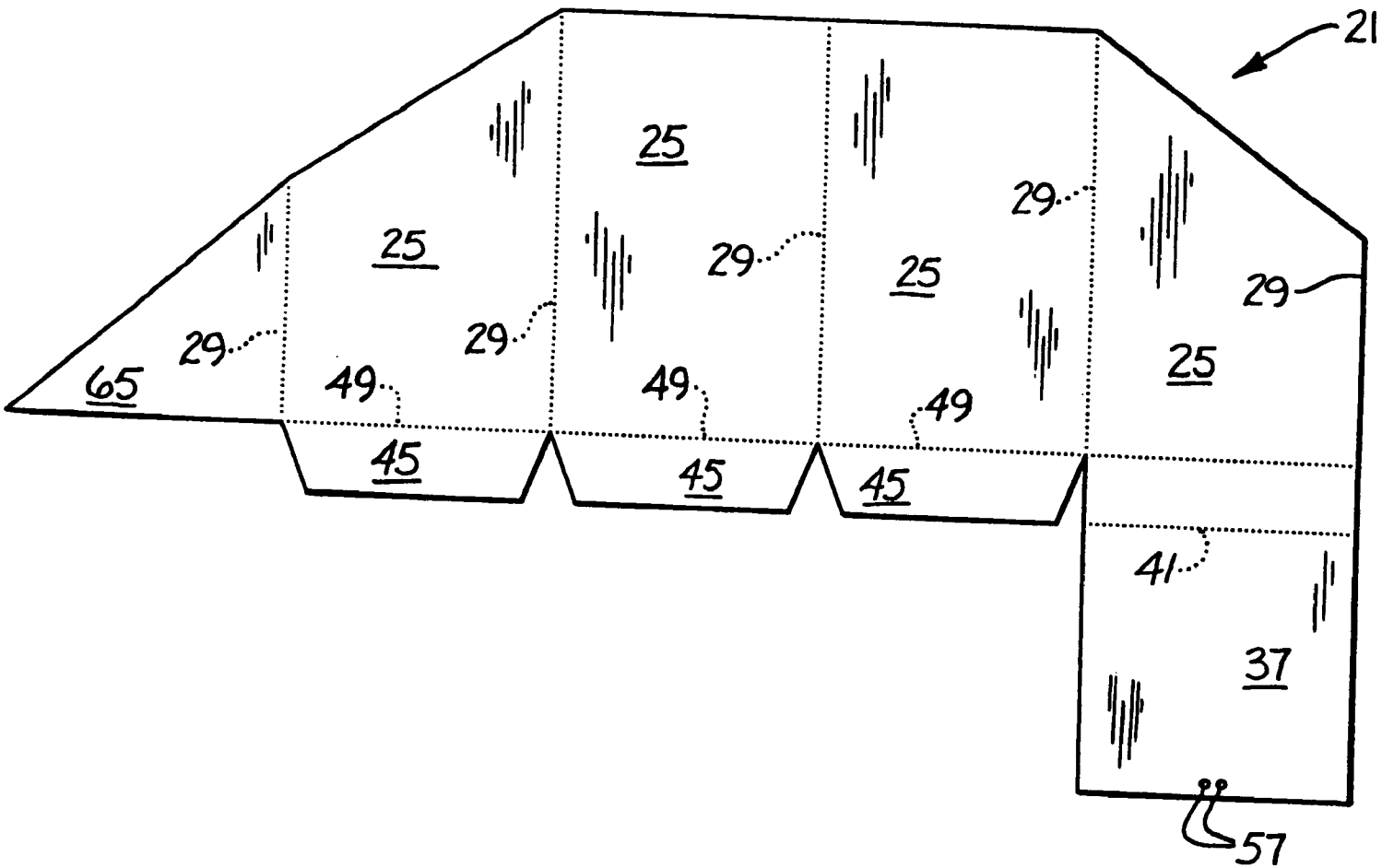
FIG. 4 is a plan view of the expandable container of FIG. 1 in an unfolded form.

In the preferred embodiment, the walls 25 and flap 37 are of unitary construction, although the present invention is readily applicable to a container 21 formed from multiple pieces of material attachable to one another. FIG. 4 shows the container 21 in its unfolded form, where the walls 25, flap 37 and stops 45 each are formed from a single piece of material. The unfolded container 21 additionally includes a segment 65 extending from a wall 25 of the unfolded container connectable along only one juncture 29. The segment 65 is designed for flatwise engagement with the wall 25 on the opposite end of the unfolded container 21, for securing the container walls in a continuous series, forming the container perimeter. The segment 65 is attachable to the opposite wall 25 in any number of ways, including adhesives, tab and slot mechanisms, tape, etc.

Furthermore, as shown in FIGS. 1–4, the walls 25 are preferably oriented perpendicular to the flap 37 when in the expanded position. When expanded, the flap 37 forms the bottom of the container 21 while the walls 25 form the container sides. Moreover, adjacent walls 25 are oriented perpendicular to one another, forming a generally rectangular container 21. Although this represents the preferred embodiment, the walls 25 and flap 37 of the container 21 may lie in any number of orientations without departing from the scope of the present invention. A sampling of such containers will be discussed in greater detail below.

The present container 21 may be used to hold a small or expandable article, such as a scarf, while in its collapsed position. Such an article may be contained within the container 21 while in the collapsed position, because the article adds little bulk to the collapsed container. The article may then serve as a surprise to the user when expanding the container 21 from its collapsed position to its expanded position for the first time. Because the scarf or other article is capable of expanding to occupy the cavity 33 from a substantially flat, collapsed position, the presence of an article within the previously collapsed container 21 is counterintuitive.

Figure 4A:
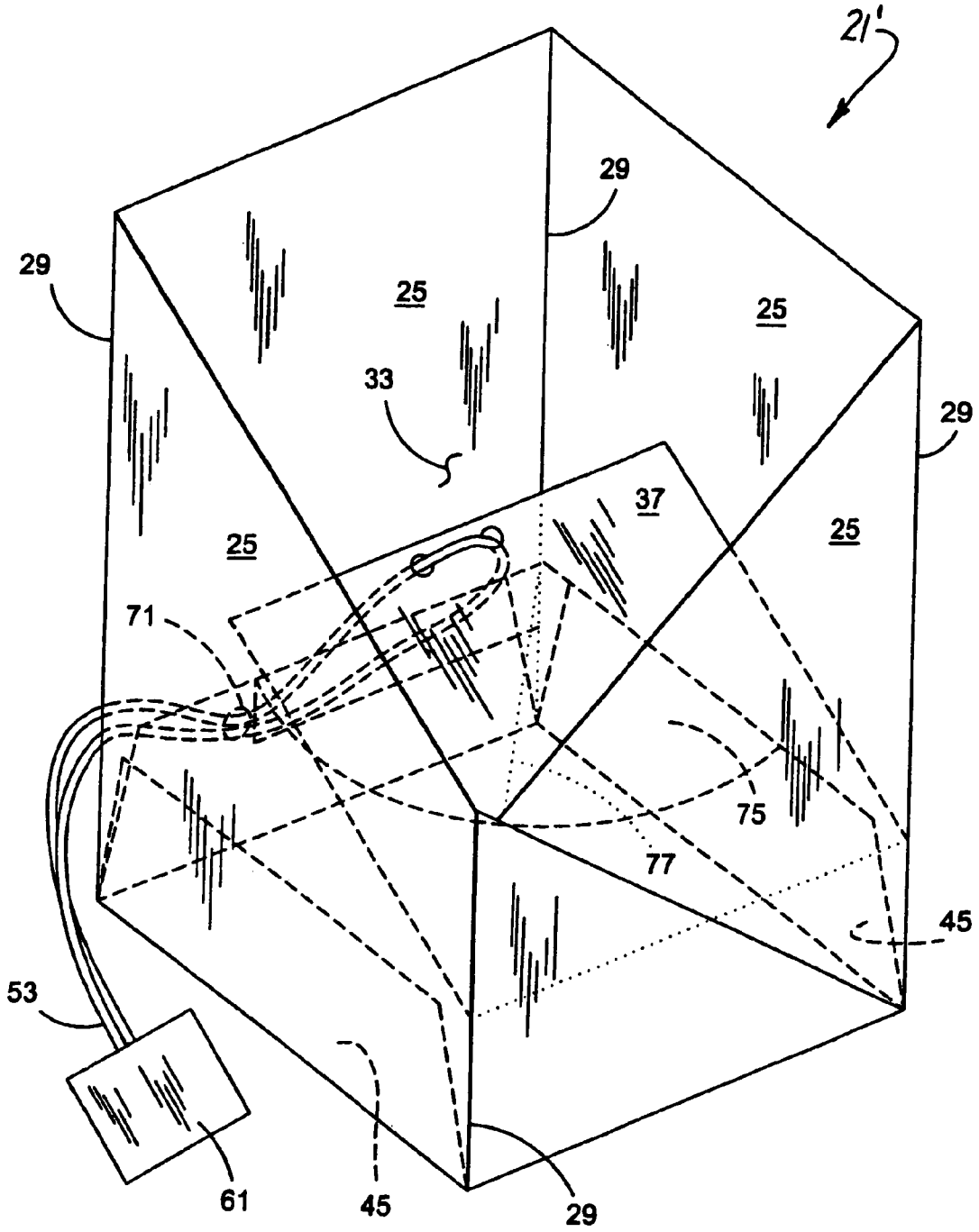
FIG. 4A is a perspective view of another embodiment of an expandable container of the present invention.
Figure 5:
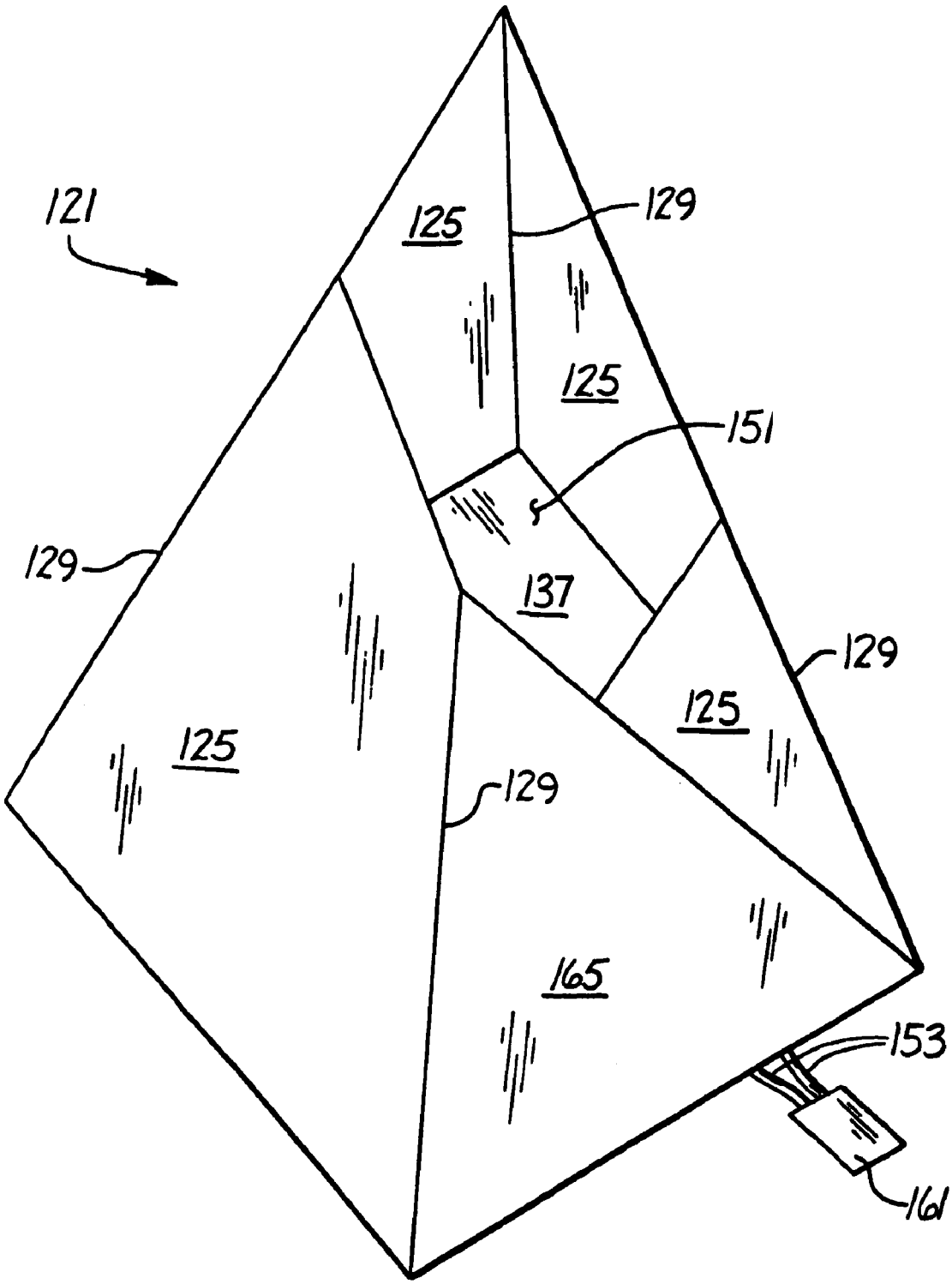
FIG. 5 is a perspective view of another embodiment of an expandable container of the present invention.
Figure 6:
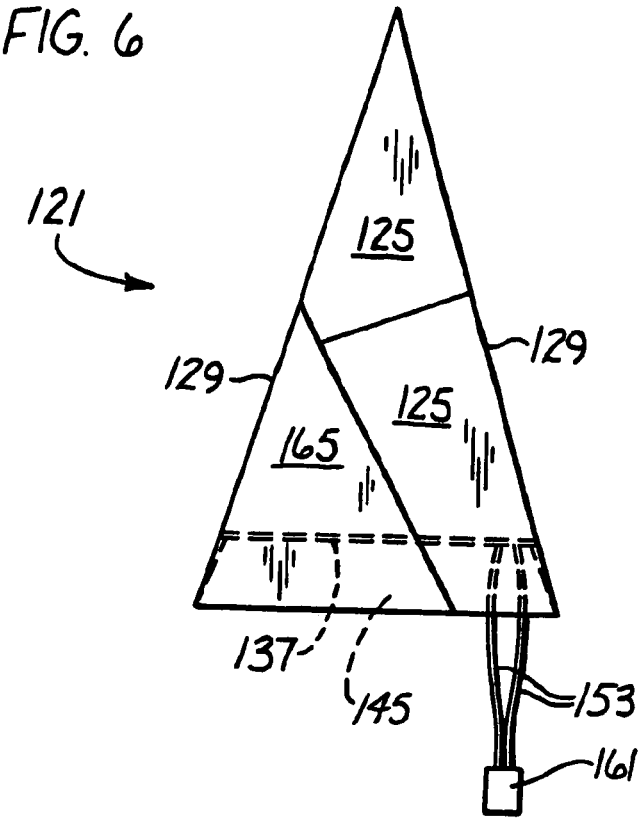
FIG. 6 is a front elevation view of the expandable container of FIG. 5 in an expanded position.
Figure 7:
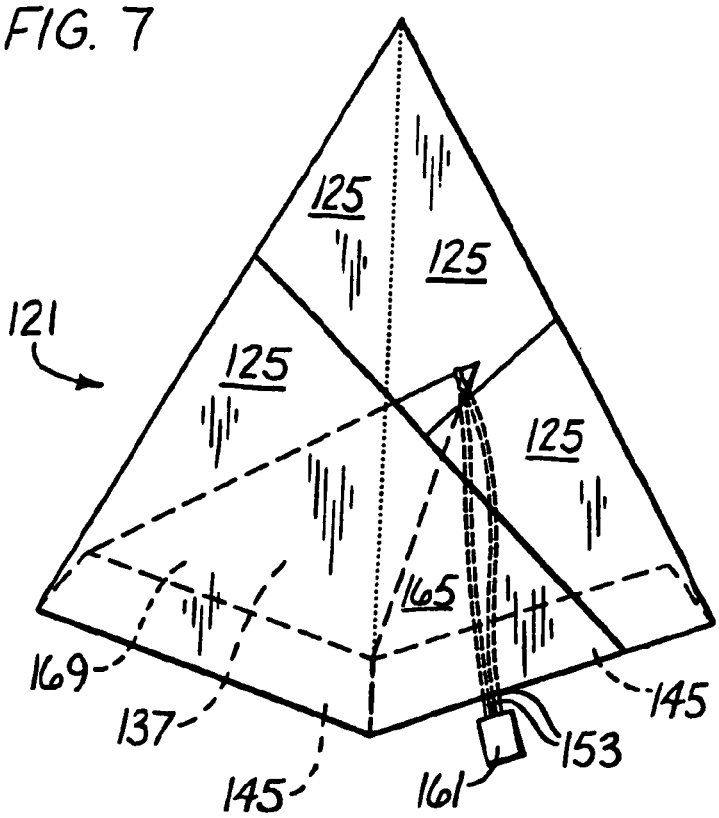
FIG. 7 is a plan view of the expandable container of FIG. 5 in a collapsed position.
Figure 8:
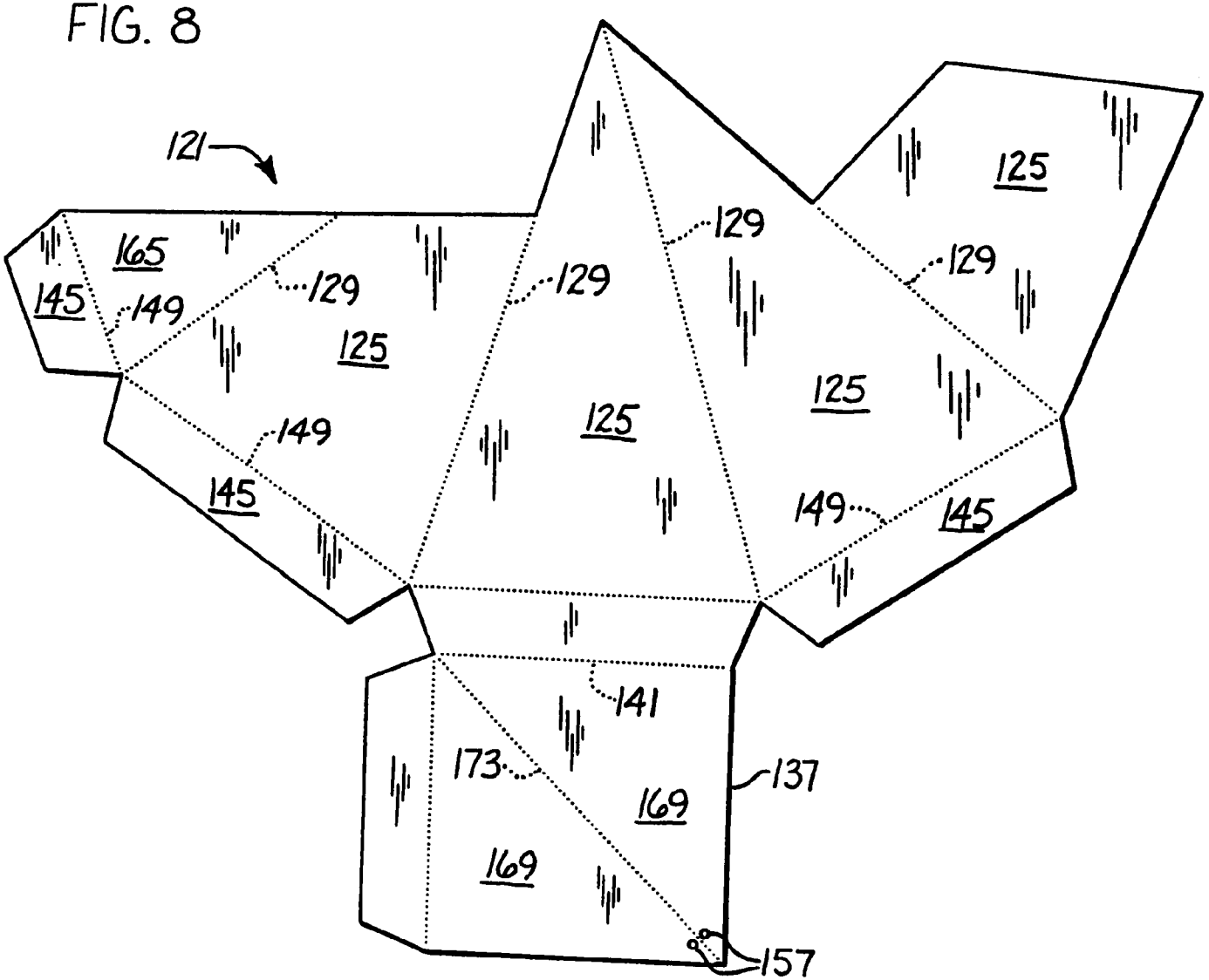
FIG. 8 is a plan view of the expandable container of FIG. 5 in an unfolded form.

FIG. 4A depicts another version of the present invention that is a variation of the container 21 of FIGS. 1–4. The container depicted in FIG. 4A is designated generally by 21'. The container 21' includes walls 25, junctures 29, a cavity 33 when expanded, a flap 37, a pull cord 53 and a pull tab 61, generally as set forth above. In addition, one wall 25 of the container 21, preferably the wall opposite the wall where the flap 37 attaches along hinged seam 41, includes a hole 71. The pull cord 53 passes through the hole 71 to guide the pull cord as the pull cord is pulled and the container expands. Furthermore, the container 21' includes a support member 75 extending across the interior of the container from the top of two adjacent stops 45. This support member 75 folds flat along fold line 77 when the container 21' is in its collapsed position, and unfolds to support the flap 37 when the container is in its expanded position. The support member 75 is preferably formed from the same single piece of material as the walls 25, flap 37 and stops 45 of the container 21'. It is also contemplated that the support member 75 could be formed from an additional piece of material attached to the container 21'.

Turning to another version of the present invention, shown in FIGS. 5–8, an expandable container 121 includes four walls 125 that are not perpendicular to the flap 137 when the container is in the expanded position. More specifically, the walls 125 are inwardly directed toward one another. The container 121 includes similar features of the preferred embodiment, including junctures 129 between the walls 125, a movable flap 137, a hinged seam 141 making the flap connectable to the container and a series of stops 145 for folding into flatwise engagement with the walls along multiple fold lines 149. The container 121 is generally pyramid-shaped, however, wherein the movable flap 137 forms a base of the pyramid and the walls 125 form sides of the pyramid. At least one of the walls 125 defines a void 151, creating an opening near the peak of the pyramid-shaped container 121. When the base of the container 121 is directed downward, the opening is upwardly directed for collection of articles within the container.

The container 121 further includes a pull cord 153 threaded through holes 157 in the flap 137 and including a pull tab 161 attachable to the free end of the pull cord 153. The pull cord 153 actuates movement of the flap 137, which includes two portions 169 that fold about one another along a fold line 173. By folding in half when moving to the collapsed position from the expanded position, the flap 137 moves upward toward the opening of the container 121. Because the walls 125 are inwardly directed, the flap 137 must fold so that it can fit within the collapsed container 121. Finally, the container includes a segment 165 shaped and sized for flatwise engagement with the wall 125 on the opposite end of the unfolded container 121, for securing the container walls in a continuous series, forming the container perimeter.

Figure 9:
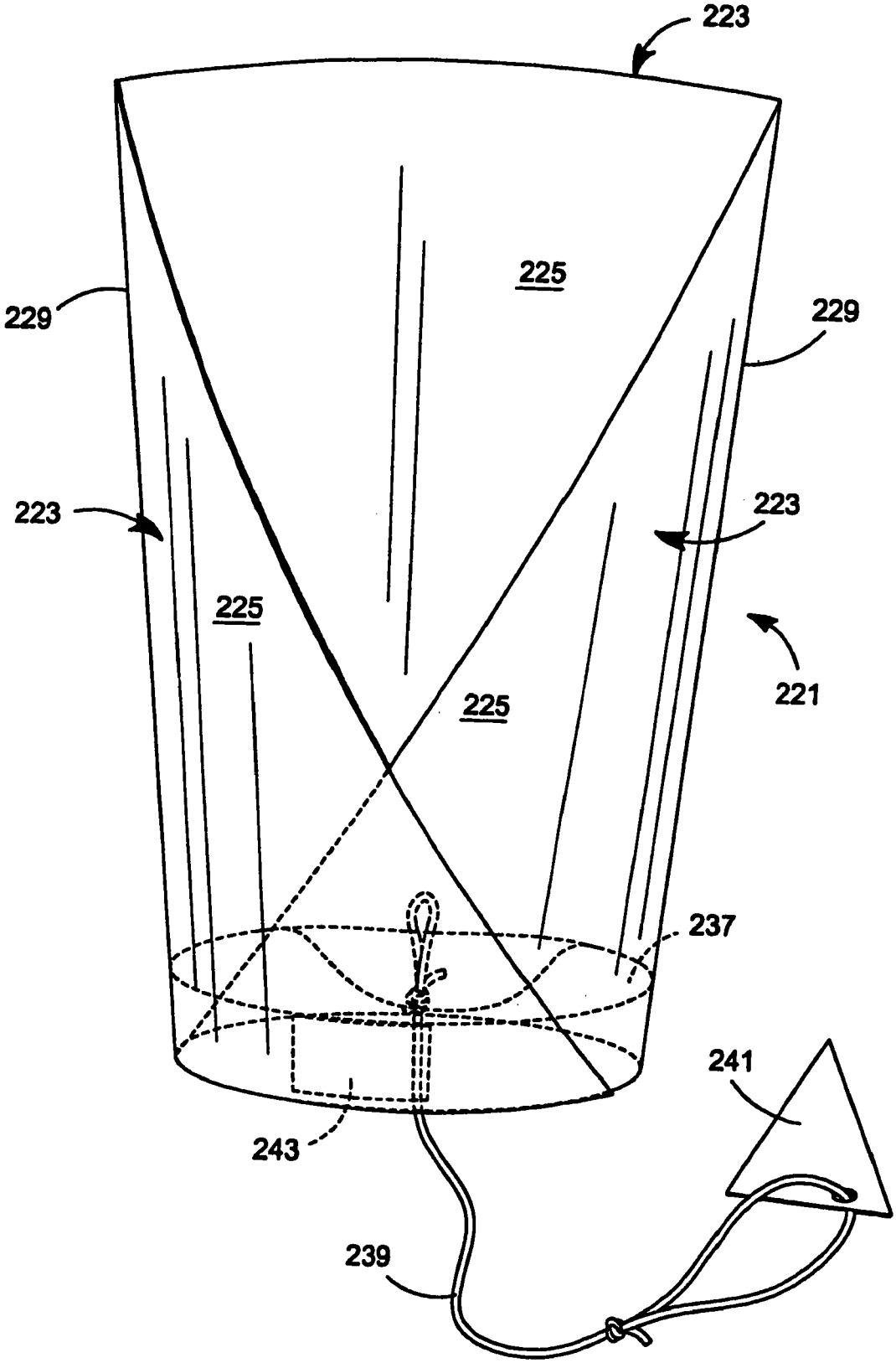
FIG. 9 is a perspective view of another embodiment of an expandable container of the present invention.

Referring now to FIG. 9, another version of a collapsible container of the present invention is generally designated by the reference numeral 221. The container 221 includes panels, generally indicated by 223, which include walls 225 joined at junctures 229 and a flap 237. The container 221 functions generally as indicated above, except that the walls 225, rather than pivoting with respect to one another, are capable of bowing outward as the flap 237 is pivoted downward by a pull cord 239, forming the container. The flap 237 is generally circular in shape, so that the bottom of the container 221 is round when in the expanded position. The top of the container 221, however, is not round, because the walls 225 are formed from a stiff material, such as cardboard, folded along the junctures 229 so that the walls bend less than at the bottom, wherein the top of the container retains an oblong shape. The container 221 further includes a pull tab 241 attachable to the pull cord 239 and a stop 243 for arresting pivoting movement of the flap 237.

Figure 10:
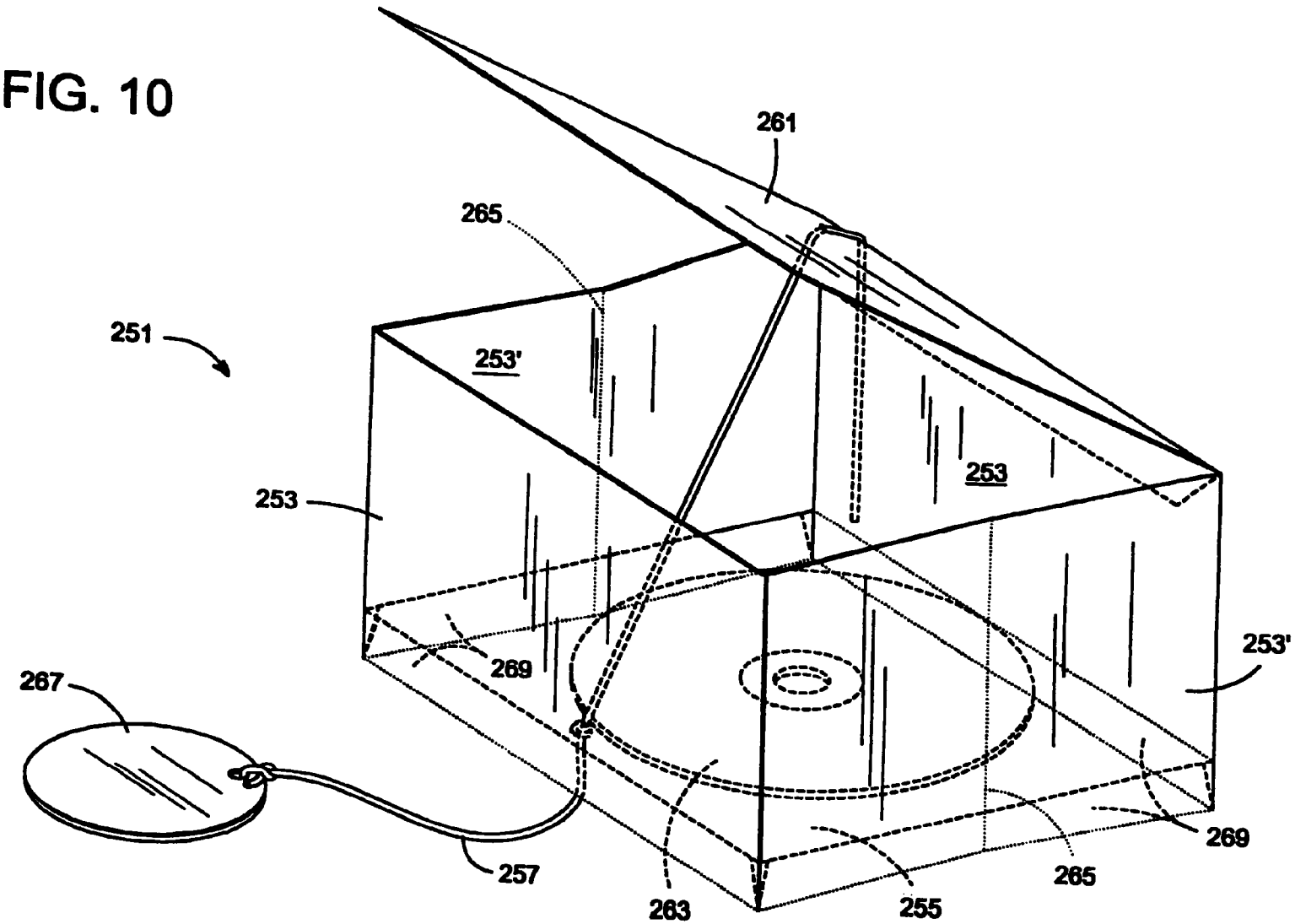
FIG. 10 is a perspective view of another embodiment of an expandable container of the present invention.

Referring now to FIG. 10, another version of the collapsible container of the present invention is generally designated by the reference numeral 251. As before, the container 251 includes walls 253, a flap 255 and a pull cord 257 for erecting the container from a collapsed position to an expanded position, as shown. The container 251 additionally includes a lid 261 attachable to one wall 253 and pivotable with respect to the container. The pull cord 257 is attachable to both the flap 255 and the lid 261, so that pulling on the pull cord to expand the container 251 also pulls the lid partially downward to demonstrate movement of the lid to the user. Moreover, the walls 253' adjacent the wall 253 connectable to the lid 261 include vertical fold lines 265, facilitating inward folding of the walls when the container is in a collapsed position. By folding inward, these walls 253' allow the container 251 to collapse to a smaller overall size. In this version, an article such as a compact disc 263 may be placed within the collapsed container 251. As the container expands from the collapsed position to the expanded position, the compact disc 263 rotates with the flap 255, thereby orienting the compact disc within the container. The container 251 further includes a pull tab 267 attachable to the pull cord 257 and a stop 269 for arresting pivoting movement of the flap 255.

Figure 11:
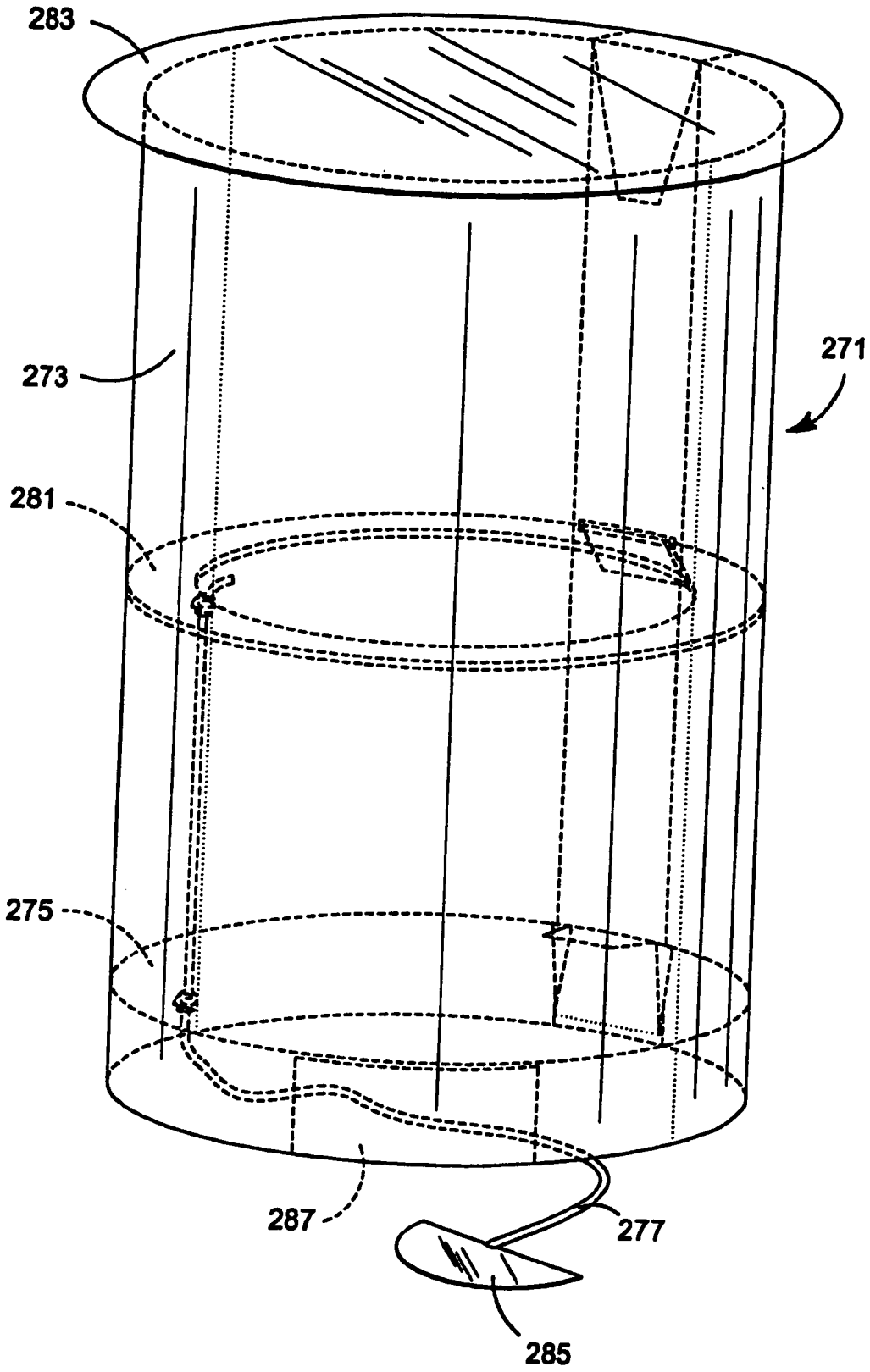
FIG. 11 is a perspective view of another embodiment of an expandable container of the present invention.

Another version of the container, shown in FIG. 11, is generally designated by the reference numeral 271. The container includes walls 273, a flap 275 and a pull cord 277 generally as above. Moreover, the container 271 includes a ring-shaped rib 281 attachable to one of the walls 273 and pivotable to a generally horizontal position with the flap 275. The rib 281 is designed to retain the walls 273 of the container in an expanded position. The pull cord 277 is attached to both the rib 281 and the flap 275. Pulling the pull cord 277 pivots the rib 281 and flap 275 from a collapsed position, where the rib and flap lie generally parallel to the walls, to an expanded position, where the rib and flap are generally perpendicular to the walls. The container 271 further includes a lid 283, attachable to and pivotable with one of the walls 273 of the container. The container 271 further includes a pull tab 285 attachable to the pull cord 277 and a stop 287 for arresting pivoting movement of the flap 275.

Figure 12:
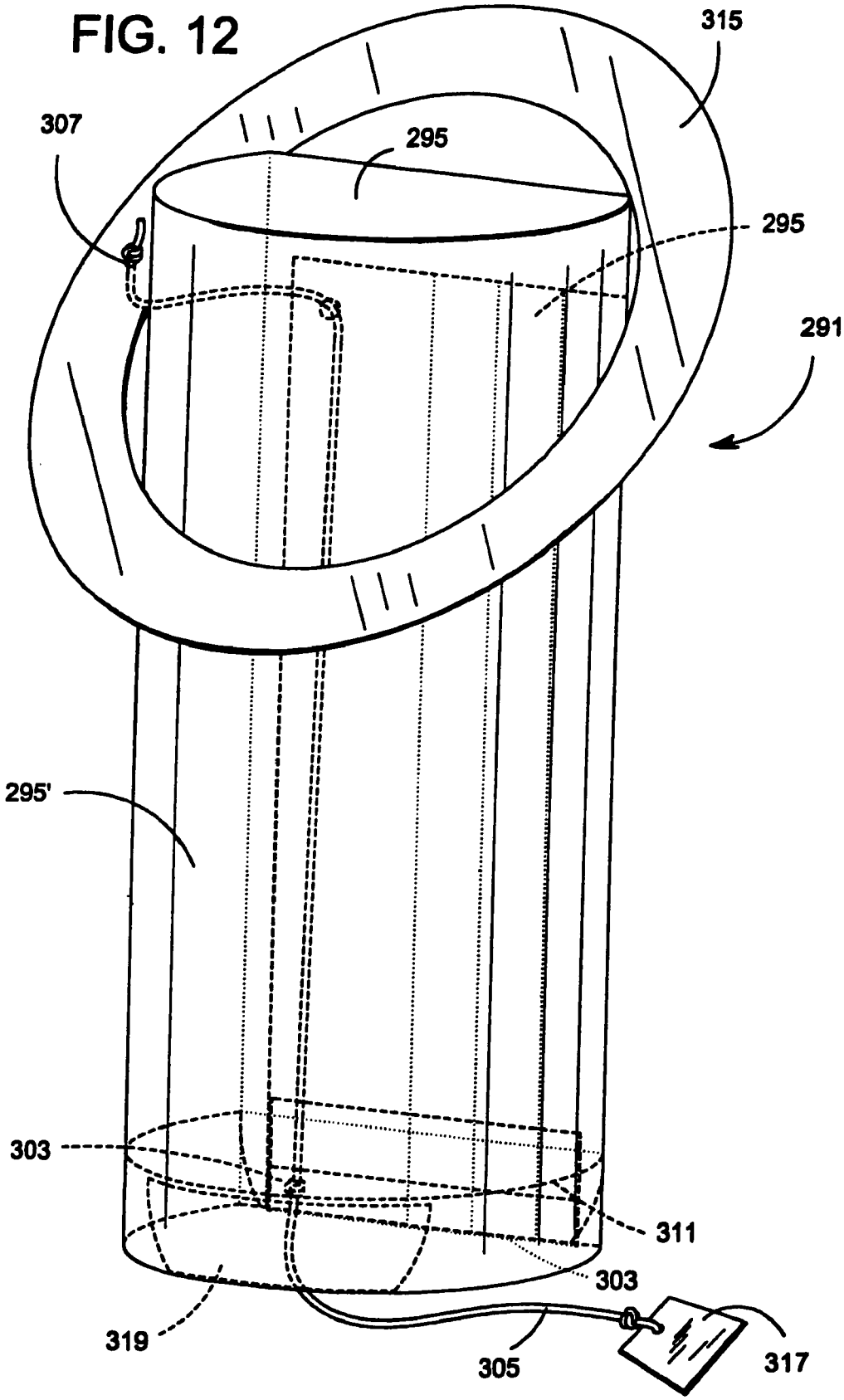
FIG. 12 is a perspective view of another embodiment of an expandable container of the present invention.

Referring now to FIG. 12, yet another version of the container of the present invention is indicated generally by reference numeral 291. The container includes three walls 295, two of which are connectable to a central wall 295'. As with the previous versions, the container 291 has both a collapsed position and an expanded position. When collapsed, the walls 295, 295' lie substantially parallel. The two outermost walls 295 are not connectable to one another along a pivotable junction as with the previous version. Rather, the bottom portion of one wall 295 is folded upward to form a crease 303 near the bottom of the wall 295. The bottom edge of the other wall 295 engages the crease 303, whereby the walls 295 may slide with respect to one another along the length of the crease. To expand the container, the user again pulls a pull cord 305 that is threaded through a series of holes 307 formed in the outermost walls 295. As the cord 305 passes through the holes 307, outermost walls 295 move inward toward one another while the crease 303 remains engagable with the bottom edge of the wall, thereby guiding the walls in flatwise, slidable engagement with one another. At the same time, the edges of the central wall 295' move inward, thereby causing the central wall to bow outwardly. The central wall 295' is shaped both by the movement of its edges inward and the movement of a semicircular flap 311 downward. The flap is also connectable to the pull cord 305, further shaping the central wall 295' in a generally arcuate shape. Finally, the pull cord 305 is connectable to a retaining ring 315 that slides downward over the upper portion of the container 291 to further secure the walls 295, 295' in the desired orientation. The container 291 further includes a pull tab 317 attachable to the pull cord 305 and a stop 319 for arresting pivoting movement of the flap 311.

Figure 13:
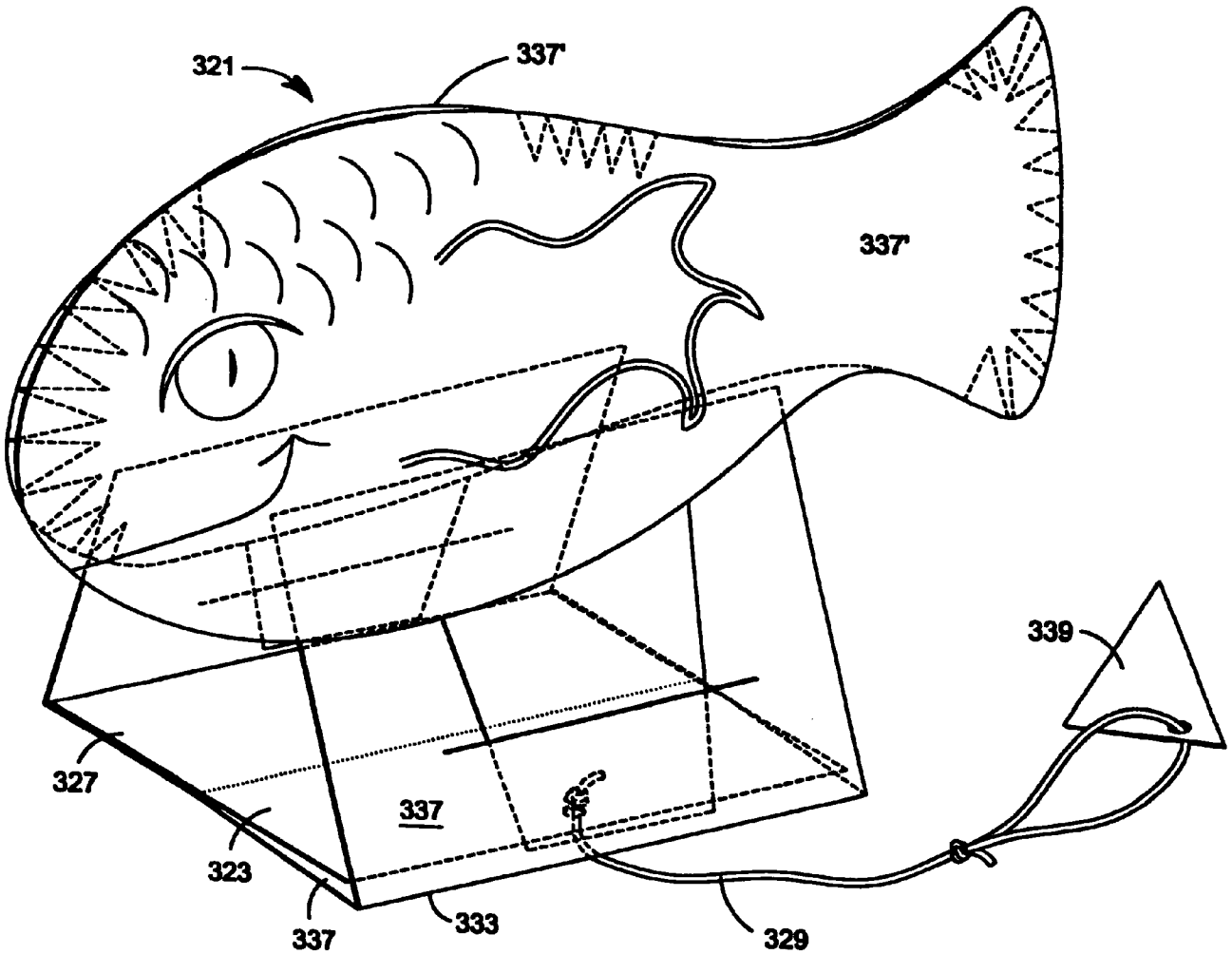
FIG. 13 is a perspective view of another embodiment of an expandable container of the present invention.

Turning to FIG. 13, another version of the container of the present invention is indicated generally by reference numeral 321. The container includes a flap 323 that is a generally parallel extension of a panel 327. As with the previous version, actuating a pull cord 329 expands the container 321 to an expanded position. As it expands the container, the flap 323 creates an interference fit between itself and a juncture 333 disposed between two adjacent panels 337, thereby securing the container in the expanded position. Only by disengaging the flap 323 from the interference fit with the juncture 333 can the user alter the container 321 from its expanded position. In addition, the container 321 includes two panels 337' sized and shaped in an outline reminiscent of a recognizable object, such as a fish, diamond ring, etc., so that the container shape is suggestive of the object. The container 321 further includes a pull tab 339 attachable to the pull cord 329.

Figure 14:
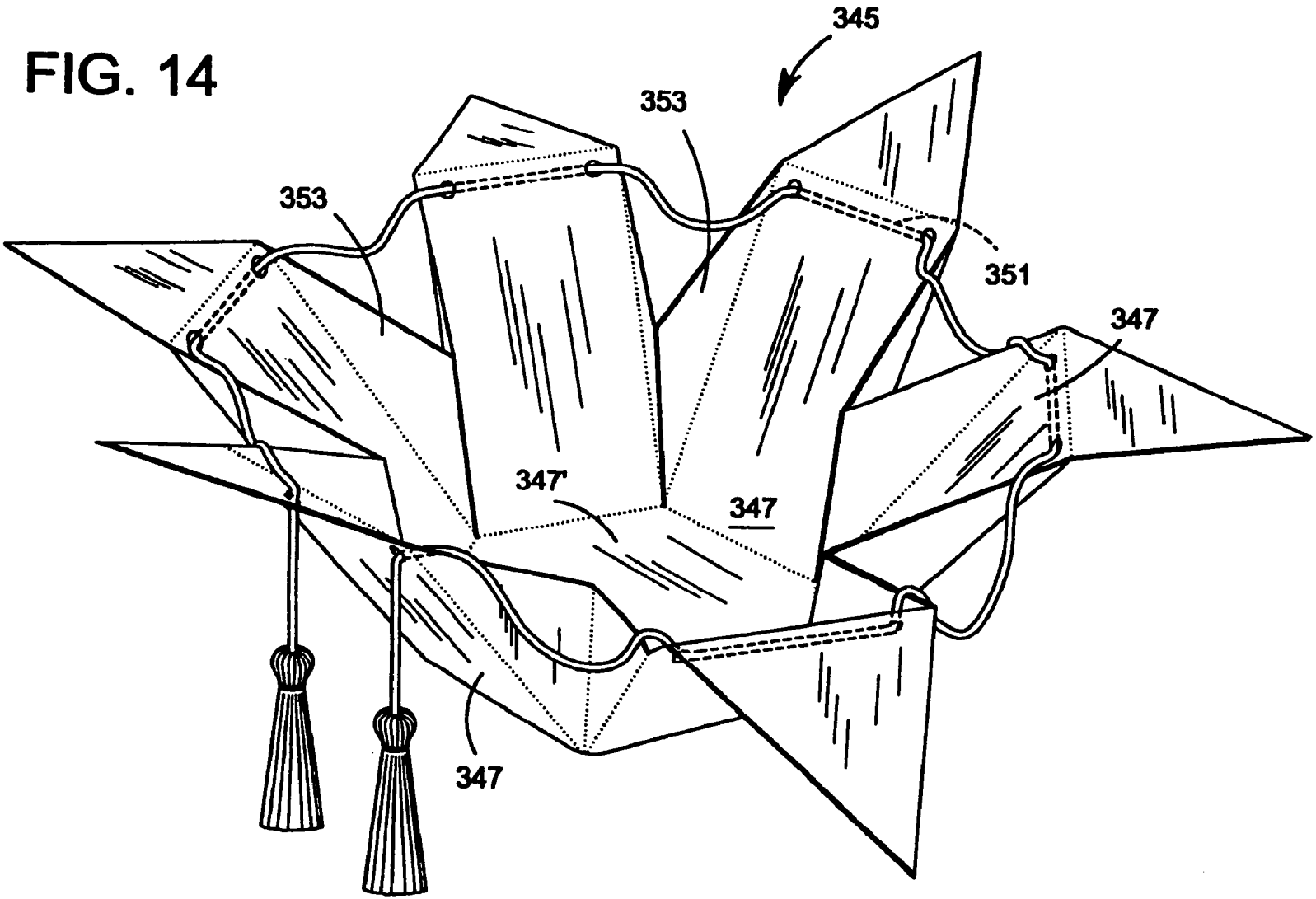
FIG. 14 is a perspective view of another embodiment of an expandable container of the present invention.

Referring now to FIG. 14, another version of the container of the present invention is indicated generally by reference numeral 345. The container 345 includes panels 347, each extendable outward from a central panel 347', or bottom, of the container. These panels 347 comprise the sides of the container 345 when in the expanded position. As depicted in FIG. 14, web panels 353 bridge the gaps between each pair of adjacent panels 347. A pull cord 351 is threadably connectable with at least two, and preferably each of the panels 347. The pull cord 351 includes two free ends extendable from the container 345 for pulling simultaneously to shorten the length of cord threading through the container, thereby expanding the panels 347 from the collapsed position to the expanded position. Preferably, the web panels 353 of the container 345 are directed inward to protect an article which may be positioned within the container, such as a fragile glass ornament or statuette. The web panels 353 may also be directed outward or removed entirely without departing from the scope of the present invention. Here the pull cord 351 may be formed of an attractive material because a portion of the cord is visible while the container is in use.

Figure 15:
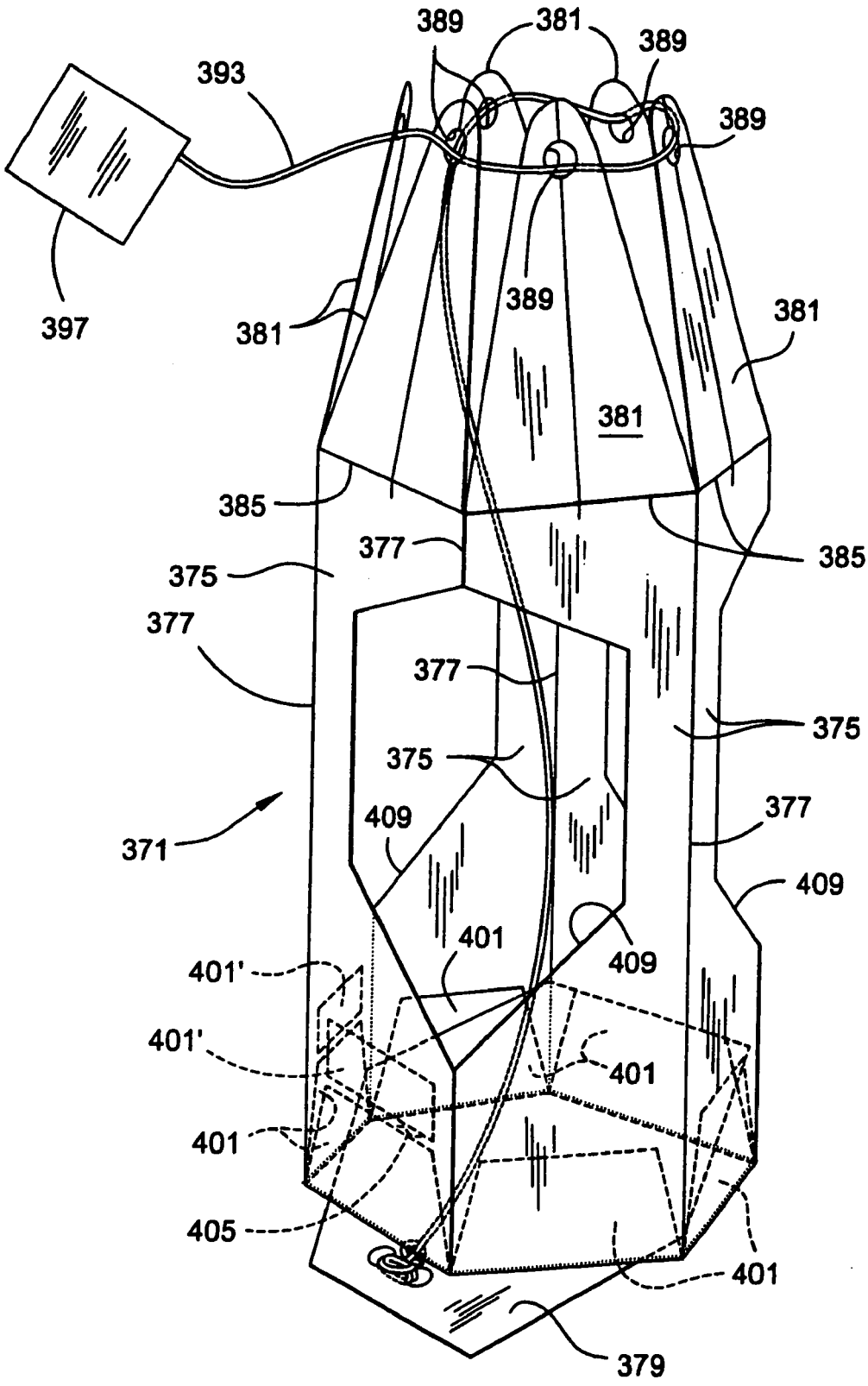
FIG. 15 is a perspective view of another embodiment of an expandable container of the present invention.

Referring now to FIG. 15, another version of the container of the present invention is indicated generally by reference numeral 371. The container includes multiple walls 375 joined at multiple junctions 377, forming a continuous circuit of walls in a circuitous arrangement. Six walls are depicted in FIG. 15, although fewer or greater number of walls (e.g., 3, 4, 5, 7, 8, etc.) are also contemplated as within the scope of the present invention. The container 371 further includes a flap 379 attachable to at least one of the walls 375 for pivotable movement with respect to the walls. As with the previous versions, the container 371 is capable of lying substantially flat in a collapsed position and expanding to an expanded position. In addition, the container 371 has wall extensions 381 extending upward from the top of each wall 375, or from at least some of the walls. These extensions 381 are movable relative to the walls 375 along fold lines 385. Each of the extensions 381 includes a hole 389, through which a pull cord 393 passes. The pull cord 393 additionally passes through the container 371 and attaches to the flap 379. From the collapsed position, when a pull tab 397 attached to the end of the pull cord 393 is pulled, the extensions 381 are drawn closer together and the flap 379 is drawn upward toward the walls of the container 371. As with the previous versions, this causes the container 371 to transform from its collapsed position to its expanded position. Once expanded, the flap 379 is positioned perpendicular to the walls 375 of the container 371 and the wall extensions 381 form a cone-shaped top of the container 371. The container further includes stops 401 as disclosed in the previous versions. Moreover, stops 401' are attached to the inner surface of the walls 375 of the container 371 to limit upward movement of the flap 379 as it is drawn into the container by the pull cord 393. These stops 401, 401' cooperate to create a notch 405 that helps hold the flap in the appropriate position. The container 371 further includes windows 409 cut from the walls of the container that allow viewing into the inside of the container.

FIGS. 16 through 21 illustrate another embodiment of a container which is generally indicated by reference numeral 521. As shown, the container 521 includes four walls 525 pivotably coupled along four junctures 529. The container 521 also includes a flap 537 pivotably coupled to at least one wall 525 along a hinged seam 541. A lid 550 is also pivotably coupled to at least one wall 525 along a hinge seam 543.

Figure 20:
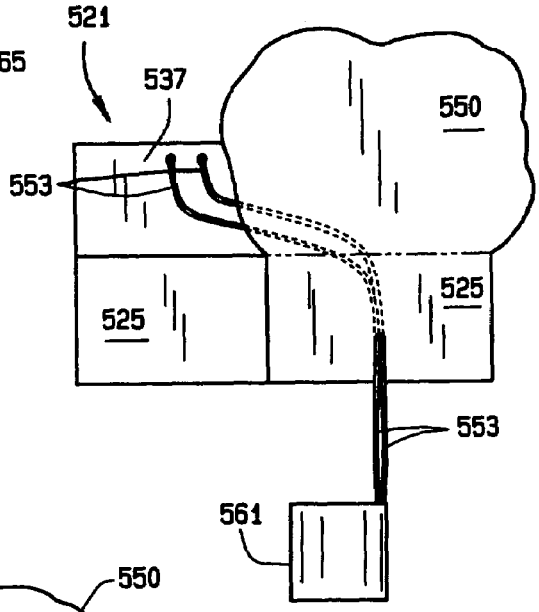
FIG. 20 is a plan view of the expandable container of FIG. 16 in a collapsed position.

As shown in FIG. 20, the walls 525, flap 537 and lid 550 can be folded together to a substantially flat, collapsed position. This, in turn, allows the container 521 to be more easily stored or shipped.

Figure 21:
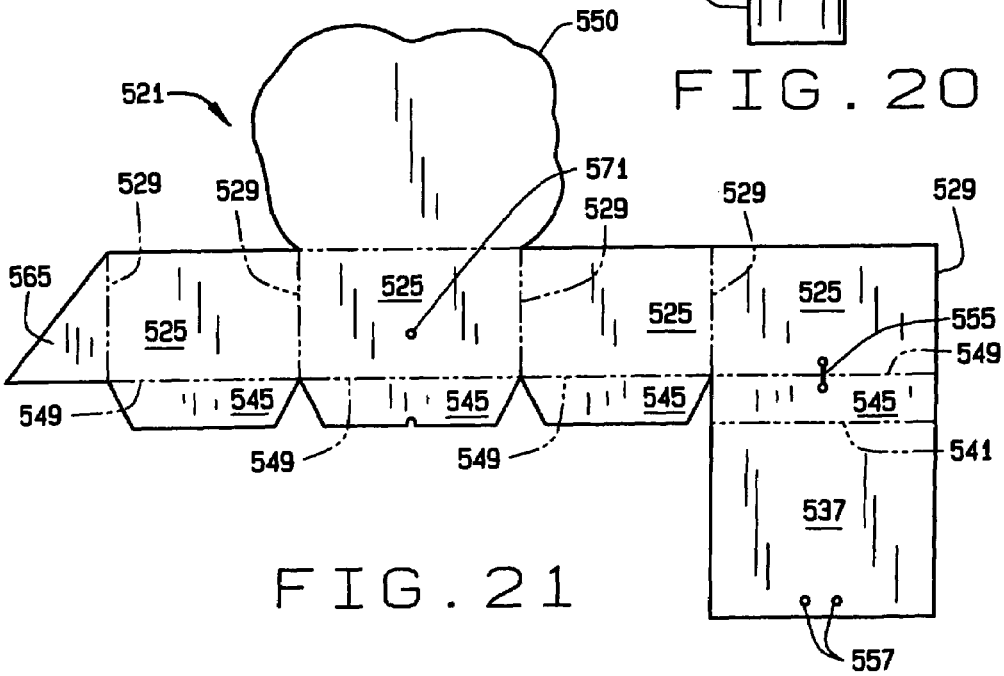
FIG. 21 is a plan view of the expandable container of FIG. 16 in an unfolded form.

Referring to FIG. 21, the walls 525 can also include upwardly folding stops 545 extending from the bottom edges of the walls along fold line 549. When the container 521 is assembled, the stops 545 are preferably folded upward for substantially flatwise engagement with their respective wall 525 of attachment. When the flap 537 rotates downward to its expanded position, the stops 545 arrest flap movement at the proper orientation.

A pull cord 553 is attached to the flap 537, preferably via two holes 557. However, other suitable methods can also be used to attach the pull cord 553 to the flap 537 such as adhesives or slots in the flap 537.

A pull tab 561 can also be attached to the free end of the pull cord 553. The pull tab 561 can be labeled with text or graphics (not shown) to help guide the user on how to use the container 521. For instance, the pull tab 561 may bear the words "Pull Here," suggesting to the user that pulling on the tab 561 will expand the container 521.

To help guide the cord 553 as it is pulled to expand the container 521, the pull cord 553 can also be threaded through at least one opening or hole 571 in at least one of the walls 525. Further, the stop 545 associated with the wall 525 through which the cord 553 is threaded can include a notch for accommodating the pull cord 553.

Figure 16:
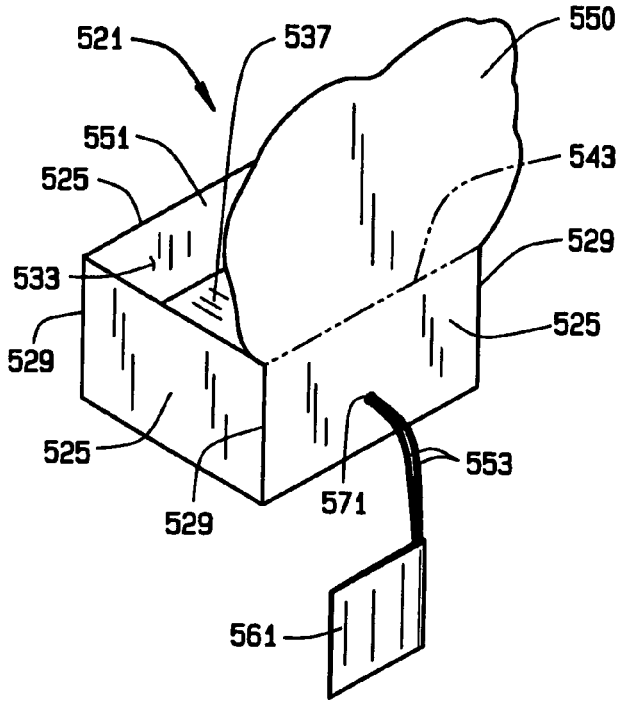
FIG. 16 is a perspective view of another embodiment of an expandable container of the present invention.
Figure 17:
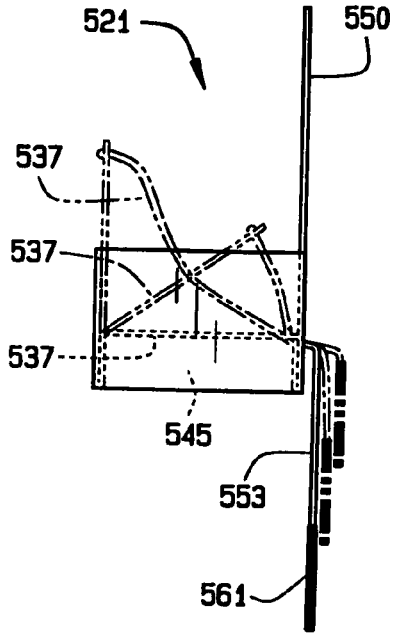
FIG. 17 is a side elevation view of the expandable container of FIG. 16 in an expanded position.
Figure 18:
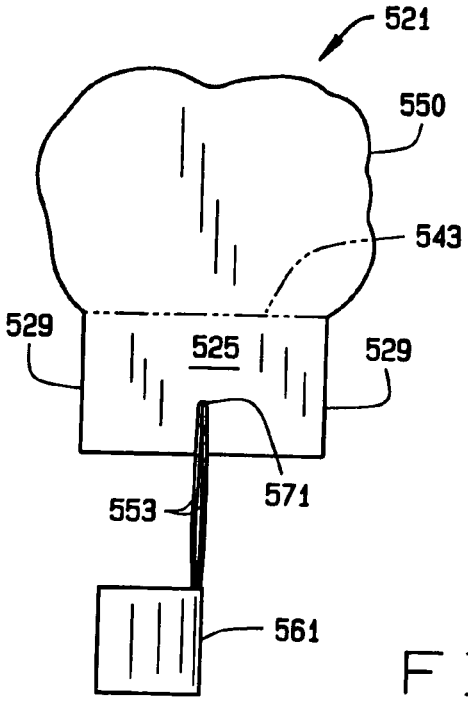
FIG. 18 is a rear elevation view of the expandable container of FIG. 16 in an expanded position.

To expand the container 521, the pull cord 553 is pulled to pivotably moves the flap 537 downward relative to the walls 525 (FIG. 17), thereby expanding the walls 525 apart from one another from the collapsed position (FIG. 20) to the expanded position (FIG. 16). This, in turn, also positions the flap 537 to define substantially the entirety of a bottom surface within the expanded container 521.

The expansion of the container 521 can also create an interference fit between the flap 537 and at least one juncture 529 between two adjacent walls 525. This interference fit frictionally maintains the container 521 in the expanded position.

The lid 550 is pivotable between at least an open position (FIG. 16) in which the lid 550 exposes an opening 551 into the cavity 533 defined by the expanded container 521 and a closed position (FIG. 19) in which the lid 550 closes the opening 551. In the illustrated embodiment, the lid 550 includes a perimeter edge that defines an outline resembling a flower bouquet. Alternatively, the perimeter edge of the lid can also define other geometric shapes or recognizable objects such as circles, triangles, rectangles, fish, among others.

Figure 19:
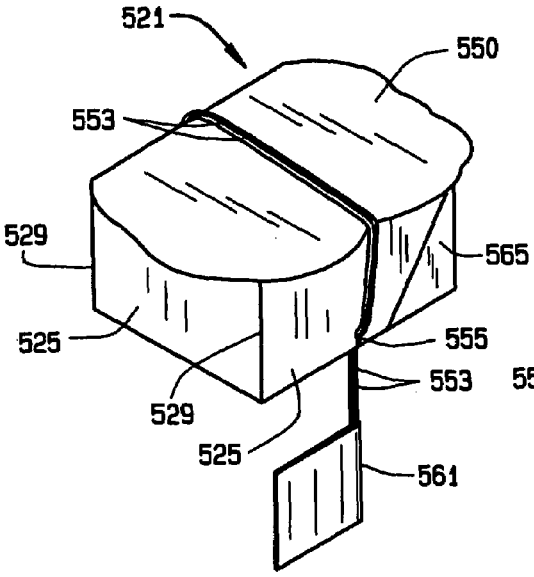
FIG. 19 is a perspective view of the expandable container of FIG. 16 in an expanded position with the lid in the closed position.

As shown in FIG. 19, the cord 553 is adapted (e.g., has sufficient length and/or elasticity, etc.) to be disposed over the lid 550 and then be removably engaged to the container 521 to retain the lid 550 in the closed position. In the illustrated embodiment, at least one of the walls 525 defines a slot or notch 555 sized to removably receive and retain therein the cord 553 after the cord 553 has been pulled over the lid 550. Alternatively, other suitable methods of removably engaging the cord 553 to the container 521 can be employed such as Velcro hook and loop fasteners, etc.

In the illustrated embodiment, the walls 525, flap 537, lid 550, and stops 545 are of unitary construction, although the present invention is readily applicable to containers formed from multiple pieces of material attachable to one another. FIG. 21 shows the container 521 in its unfolded form in which the walls 525, flap 537, lid 550, and stops 545 are formed from a single piece of material.

The unfolded container 521 additionally includes a segment 565 extending from a wall 525 of the unfolded container and which is connectable along only one juncture 529. The segment 565 is designed for flatwise engagement with the wall 525 on the opposite end of the unfolded container 521, for securing the container walls in a continuous series to form the container perimeter. The segment 565 can be attached to the opposite wall 525 in any number of ways, including adhesives, tab and slot mechanisms, tape, Velcro hook and loop fasteners, etc.

In the illustrated embodiment, the walls 525 are oriented perpendicular to the flap 537 when the container 521 is expanded. In addition, the flap 537 forms the bottom of the expanded container 521 while the walls 525 form the expanded container's sides. Moreover, adjacent walls 525 are oriented perpendicular to one another, forming a generally rectangular container 521. Although this represents a preferred embodiment, the walls 525 and flap 537 of the container 521 may lie in any number of orientations without departing from the scope of the present invention.

In another form, the present invention provides methods of expanding and closing an expandable container. In one embodiment, the method generally includes pulling a pull cord coupled to a flap to pivotably move the flap relative to the container walls to expand the walls apart from one another from a collapsed position to an expanded position, moving a lid pivotably coupled to at least one of the walls from an open position in which the lid exposes an opening defined by the expanded container to a closed position in which the lid closes the opening, positioning the cord over the lid, and removably engaging the cord with the container to retain the lid in the closed position.

In at least some embodiments, the cord need only be pulled in a single direction to expand the container. Further, moving the lid from the open position to the closed position can be accomplished by pulling the cord over the lid to pivotably move the lid from the open position to the closed position.

The cord can be removably engaged to the container by positioning the cord within at least one slot defined by at least one of the walls of the container. Additionally, pulling the cord coupled to the flap can also create an interference fit between the flap and at least one juncture between two adjacent walls of the container. Once created, this interference fit can frictionally maintain the container in the expanded position.

In addition to the various containers described herein, other containers of similar design are also contemplated as within the scope of the present invention. For instance, the container walls may also slope outwardly (not shown), forming a container with a progressively larger opening as one goes further upward on the container. The container may also be formed with walls in a combination of orientations, for example, inward, outward or vertical. Moreover, containers including a differently shaped flap are also contemplated as within the scope of the present invention (e.g., a triangle-shaped flap, a hexagonal flap, etc.). In sum, a variety of containers formed in various configurations and sizes are well within the scope of the present invention.

In view of the above, it will be seen that various advantageous results are achieved with the invention. For example, embodiments of the present invention provide expandable containers which are readily expandable to their expanded positions by pulling a pull cord thus making such containers easy to operate without complex instructions. Embodiments also provide expandable containers that can be readily collapsed for easy storage and/or transportation thereof. Embodiments also provide expandable containers which can be formed in various shapes and sizes for various applications and/or which can be covered with various designs and pictures to enhance their appearance. Expandable containers of the present invention can be readily altered between their expanded and collapsed positions multiple times.

When introducing elements or features of the present invention and the exemplary embodiments, the articles "a", "an", "the" and "said" are intended to mean that there are one or more of such elements or features. The terms "comprising", "comprise", "including", "include", "having", and "have" are intended to be inclusive and mean that there may be additional elements or features other than those specifically noted.

The description of the invention is merely exemplary in nature and, thus, variations that do not depart from the gist of the invention are intended to be within the scope of the invention. Such variations are not to be regarded as a departure from the spirit and scope of the invention.

What is claimed:

1. An expandable container comprising at least two walls pivotably coupled along a juncture so as to lie substantially flat in a collapsed position, a flap pivotably coupled to at least one of the walls, a pull cord coupled to the flap such that pulling only the cord in a single direction pivotably moves the flap relative to the walls thereby expanding the walls apart from one another from the collapsed position to an expanded position, a lid pivotably coupled to at least one of the walls for pivotable movement between at least an open position in which the lid exposes an opening defined by the expanded container and a closed position in which the lid closes the opening, the cord being adapted to be disposed over the lid and be removably received and retained within at least one slot defined by at least one of the walls to retain the lid in the closed position, wherein expansion of the container to an expanded position creates an interference fit between the flap and at least one juncture between two adjacent walls, the interference fit frictionally maintaining the container in the expanded position.

2. The container of claim 1 wherein the flap defines substantially the entirety of a bottom surface within the expanded container.

3. The container of claim 1 wherein at least one of the walls defines a hole therein through which the cord is threaded.

4. The container of claim 1 wherein the walls, flap and lid fold to a substantially flat, collapsed position.

5. The container of claim 1 wherein the walls, flap and lid are of unitary construction.

6. The container of claim 5 wherein the lid is an extension of a wall, and wherein the flap is an extension of a wall.

7. The container of claim 1 wherein the walls are oriented perpendicular to the flap when in the expanded position.

8. The container of claim 7 wherein the walls that are adjacent one another are oriented perpendicular to one another.

9. An expandable container comprising at least two walls pivotably coupled along a juncture so as to lie substantially flat in a collapsed position, a flap pivotably coupled to at least one of the walls, a pull cord coupled to the flap such that pulling only the cord in a single direction pivotably moves the flap relative to the walls thereby expanding the walls apart from one another from the collapsed position to an expanded position, a lid pivotably coupled to at least one of the walls for pivotable movement between at least an open position in which the lid exposes an opening defined by the expanded container and a closed position in which the lid closes the opening, the cord being adapted to be disposed over the lid and be removably received and retained within at least one slot defined by at least one of the walls to retain the lid in the closed position, wherein the flap defines substantially the entirety of a bottom surface within the expanded container.

10. The container of claim 9 wherein expansion of the container to an expanded position creates an interference fit between the flap and at least one juncture between two adjacent walls, the interference fit frictionally maintaining the container in the expanded position.

11. The container of claim 9 wherein at least one of the walls defines a hole therein through which the cord is threaded.

12. The container of claim 9 wherein the walls, flap and lid fold to a substantially flat, collapsed position.

13. The container of claim 9 wherein the walls, flap and lid are of unitary construction.

14. The container of claim 9 wherein the lid is an extension of a wall, and wherein the flap is an extension of a wall.

15. The container of claim 9 wherein the walls are oriented perpendicular to the flap when in the expanded position.

16. The container of claim 15 wherein the walls that are adjacent one another are oriented perpendicular to one another.

* * * * *